US007367123B2

(12) United States Patent
Itzel et al.

(10) Patent No.: US 7,367,123 B2
(45) Date of Patent: May 6, 2008

(54) COATED BUCKET DAMPER PIN AND RELATED METHOD

(75) Inventors: Gary Michael Itzel, Simpsonville, SC (US); Ariel Caesar-Prepena Jacala, Simpsonville, SC (US); Doyle C. Lewis, West Union, SC (US); Kathleen B. Morey, Scotia, NY (US); David V. Bucci, Simpsonville, SC (US); Ganjiang Feng, Greenville, SC (US)

(73) Assignee: General Electric Company, Schenectady, NY (US)

( * ) Notice: Subject to any disclaimer, the term of this patent is extended or adjusted under 35 U.S.C. 154(b) by 109 days.

(21) Appl. No.: 11/127,174

(22) Filed: May 12, 2005

(65) Prior Publication Data

US 2006/0257262 A1 Nov. 16, 2006

(51) Int. Cl.
*B21K 25/00* (2006.01)

(52) U.S. Cl. ..... 29/889.2; 416/500

(58) Field of Classification Search ..... 416/220 R, 416/248, 500; 29/889.2
See application file for complete search history.

(56) References Cited

U.S. PATENT DOCUMENTS

| | | | | |
|---|---|---|---|---|
| 3,709,631 | A * | 1/1973 | Karstensen et al. | 416/95 |
| 5,156,528 | A | 10/1992 | Bobo | |
| 5,827,047 | A | 10/1998 | Gonsor et al. | |
| 6,354,803 | B1 | 3/2002 | Grover et al. | |
| 6,390,775 | B1 | 5/2002 | Paz | |
| 6,435,830 | B1 * | 8/2002 | Allen et al. | 416/193 A |
| 6,450,769 | B2 | 9/2002 | Szwedowicz | |
| 6,776,583 | B1 * | 8/2004 | Wang et al. | 416/220 R |
| 6,851,932 | B2 | 2/2005 | Lagrange et al. | |

* cited by examiner

*Primary Examiner*—Edward K. Look
*Assistant Examiner*—Devin Hanan
(74) *Attorney, Agent, or Firm*—Nixon & Vanderhye, PC

(57) ABSTRACT

A damper pin for a turbine bucket includes an elongated main body portion of substantially uniform cross-sectional shape having opposite ends, one only of said opposite ends coated with a corrosion and oxidation-resistant coating.

5 Claims, 2 Drawing Sheets

COATED BUCKET DAMPER PIN AND RELATED METHOD

BACKGROUND OF THE INVENTION

The present invention relates generally to turbines having a plurality of circumferentially-spaced buckets about the periphery of a rotor wheel, and particularly, to bucket damper pins disposed between adjacent buckets for damping bucket vibrations.

As is well known, turbines generally include a rotor comprised of a plurality of rotor wheels, each of which mounts a plurality of circumferentially-spaced buckets. The buckets each typically include an airfoil, a platform, a shank and a dovetail, the dovetail being received in a mating dovetail slot in the turbine wheel. The airfoils project into the hot gas path of the turbine and convert kinetic energy into rotational mechanical energy. During engine operation, vibrations are introduced into the turbine buckets and if not dissipated, can cause premature failure of the buckets.

Many different forms of vibration dampers have been proposed to minimize or eliminate vibrations. See, for example, U.S. Pat. Nos. 6,851,932; 6,354,803; 6,390,775; 6,450,769; 5,827,047 and 5,156,528.

The '932 patent describes a damper pin located between each adjacent pair of buckets for reducing the amplitude of vibratory stresses at full speed—full load and full speed—no load conditions.

Nevertheless, today's high-firing-temperature gas turbines require improvement in corrosion and oxidation resistance capabilities for bucket damper pins exposed to a high temperature environment, while maintaining required sealing, damping and wear characteristics. Damper pin corrosion and oxidation distress can cause loss of damping leading to mechanical failure, liberation of the bucket causing damage to other turbine components, and/or compressor discharge flow leakage leading to reduced engine efficiency, etc.

Older damper pin designs have not required corrosion and oxidation protection since the damper pins were used in gas turbines operating at lower firing temperatures, and since film cooling carryover from upstream nozzle side walls tended to reduce the temperature of the air to which the pins were exposed. New gas turbine designs with closed loop airfoil cooling, however, significantly reduce film cooling of upstream airfoils in an attempt to increase turbine efficiencies. The reduction in film cooling, along with the increase in firing temperatures, significantly increase the temperature at the leading edge of the damper pins. In addition, in previous designs, increased wheel space purge flow was required to maintain the required temperature to assure the damper pins did not oxidize. The addition of purge flow, however, reduces turbine efficiency, and thus is not an acceptable solution.

BRIEF DESCRIPTION OF THE INVENTION

In accordance with an exemplary embodiment of the invention, a corrosion and oxidation resistant coating is applied to the leading end of the bucket damper pin, i.e., that end exposed to a high temperature environment. In this regard, both ends of the otherwise substantially cylindrical pin are machined to have generally semi-circular cross sections. Substantially the entire surface of the semi-circular leading end is machined so as to form a stepped surface area about the leading end. This machined surface is then filled with the corrosion and oxidation-resistant coating, such that the coated outer surface of the leading end has the exact dimensions as the original leading end prior to machining. The applied coating protects the underlying superalloy by forming a corrosion and/or oxidation barrier for the underlying substrate, specifically a dense adherent aluminum oxide layer, sometimes referred to as an "alumina scale" that typically forms at elevated temperatures. The alumina oxide scale protects the bond coat from corrosion and oxidation. It will be appreciated that protective coating could be any alumina-forming coating resulting from a spray deposition or a diffusion aluminizing process.

In an exemplary embodiment, the protective coating is a dense MCrAlY coating, where M is iron, cobalt, and/or nickel. The coating may be applied by any appropriate deposition technique including high velocity, oxi-fuel, high velocity air-fuel, air plasma spray, vacuum or low pressure plasma spray, wire arc, or flame spray. Other non-spray techniques such as cladding and presintered braze preforms could also be used to adhere the alumina-forming chemistry to the damper pin. The coating thickness may cause the leading end to exceed the original leading end cross-sectional area, but subsequent machining will insure that the final coated leading end cross-sectional shape and area will match the original cross-sectional shape and area of the non-coated leading end. By coating only the surfaces at the leading end of the damper pin, the remainder of the pin can continue to use a material optimized for damping, sealing and wear requirements.

Accordingly, in one aspect, the present invention relates to a damper pin for a turbine bucket comprising an elongated main body portion of substantially uniform cross-sectional shape having opposite ends, one only of the opposite ends coated with a corrosion and oxidation-resistant coating.

In another aspect, the present invention relates to a turbine rotor wheel comprising a plurality of circumferentially arranged buckets, each adjacent pair of buckets having a damper pin inserted therebetween, the damper pin comprising an elongated main body portion of substantially uniform cross-sectional shape having opposite leading and trailing ends of different cross-sectional shape than said main body portion, only the leading end coated with a corrosion and oxidation-resistant coating.

In still another aspect, the present invention relates to a method of reducing corrosion and oxidation at a leading end of a damper pin located between adjacent buckets on a steam turbine rotor wheel comprising (a) machining the leading end to reduce a cross-sectional area of the leading end; and (b) applying a corrosion and oxidation-resistant coating to only the one end to a thickness such that the one end has a cross-sectional shape and area substantially equal to the leading end prior to step (a).

The invention will now be described in connection with the drawings identified below.

DETAILED DESCRIPTION OF THE INVENTION

Figure 1:
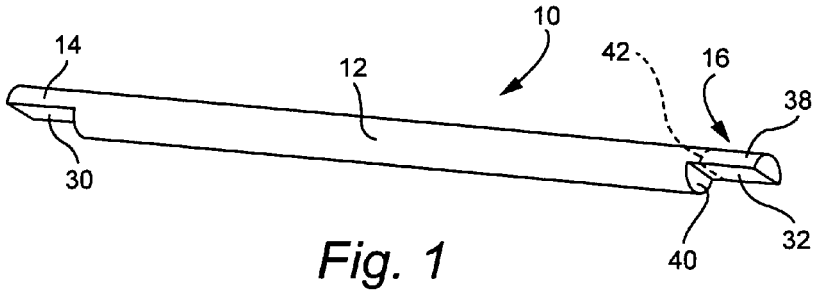
FIG. 1 shows a coated bucket damper pin used to seal the gap between adjacent buckets in accordance with the invention.

FIG. 1 illustrates a damper pin 10 having an elongated, substantially cylindrical main body portion 12, machined to create a pair of semi-circular end regions or ends 14 and 16. The leading end 16 is coated as described further below.

Figure 2:
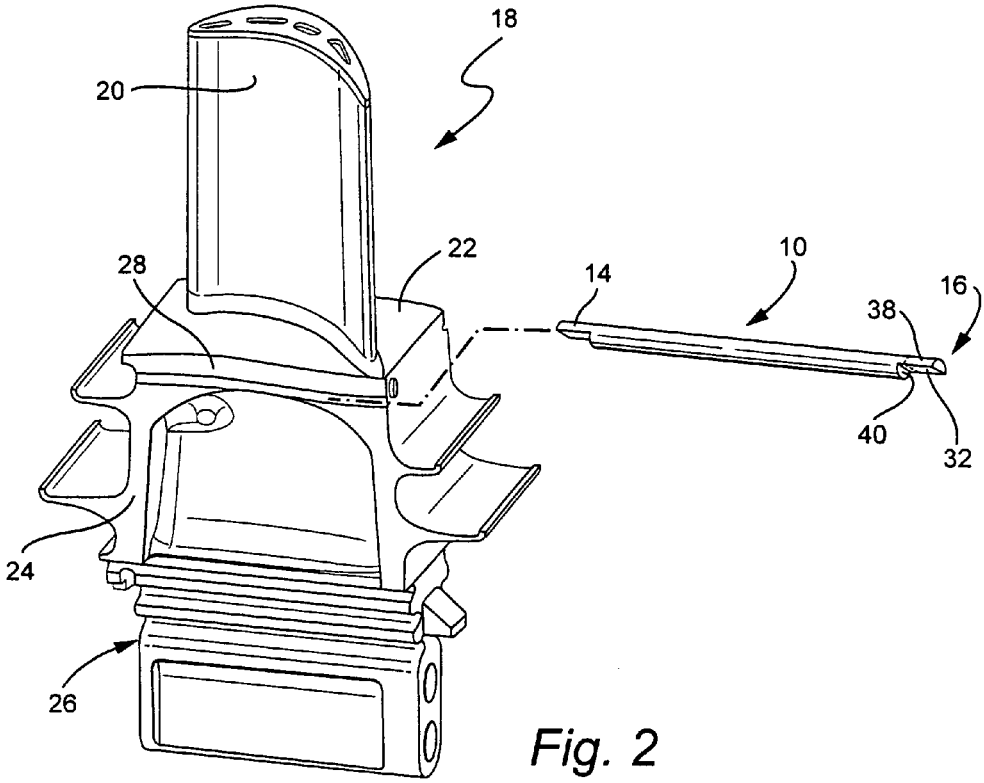
FIG. 2 is a perspective view of a gas turbine bucket and damper pin assembly.
Figure 3:
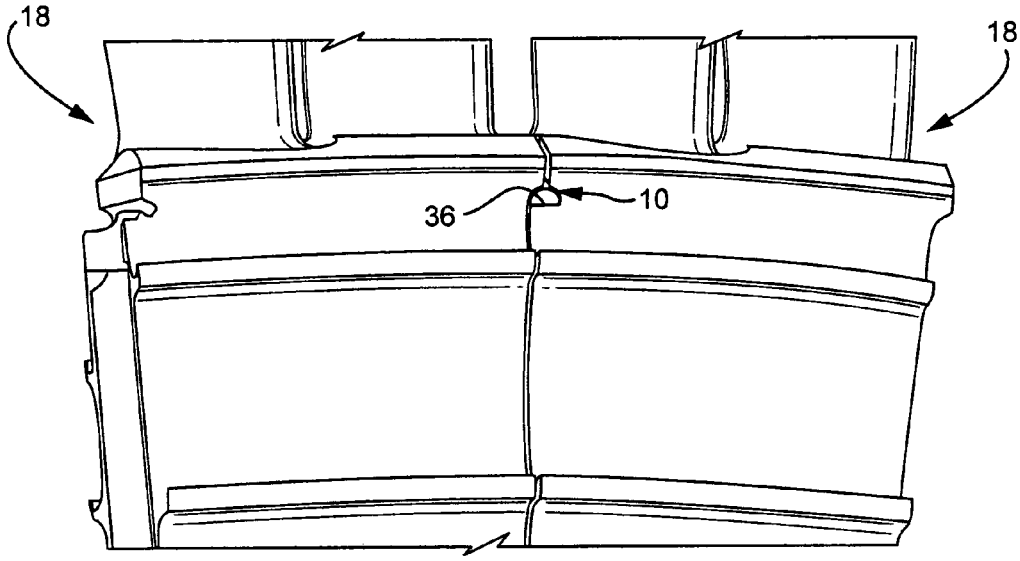
FIG. 3 is a partial side elevation of a pair of circumferentially adjacent buckets with a damper pin located therebetween.

FIG. 2 illustrates a conventional bucket 18 including an airfoil 20, a platform 22, a shank 24 and a dovetail 26. It will be understood that the dovetail is utilized to secure the bucket about the outer periphery of the rotor wheel (not shown) as is well known in the art. The damper pin 10 is located along one axial edge 28 adjacent the bucket platform 22 with the leading edge 14 of the damper pin located at the leading edge of the bucket and trailing end 16 located at the trailing end of the bucket. It will be appreciated that similar pins are located between each adjacent pair of buckets 18 on the turbine wheel, as apparent from FIG. 3.

The pin 10 in the illustrated embodiment includes a substantially cylindrical body portion 30 and the pair of semi-circular (reduced cross-section) opposite ends 14, 16. With this arrangement, flat support surfaces 32, 34, respectively, are able to rest on machined bucket platform surfaces 36 (one shown in FIG. 3) at opposite ends of the bucket. This arrangement provides good support for the pin while also preventing undesirable rotation thereof during operation of the turbine. The leading end 16 of the damper pin 10 is especially vulnerable to oxidation and/or corrosion because it is exposed to high temperatures in the turbine hot gas flow path.

Typically, the damper pin 10 is constructed of a suitable cobalt alloy. To reduce the potential for oxidation and/or corrosion, the leading end has an oxidation and corrosion-resistant coating 38 applied thereto. The coating 38 is an MCrAlY coating, where M is iron, cobalt and/or nickel. For example, the coating comprise 38% by weight cobalt, 32% by weight Nickel, 22% by weight Chromium, 10% by weight aluminum and 0.3% by weight yttria. Another suitable coating comprises 66% by weight Nickel, 22% by weight Chromium, 10% by weight aluminum and 1% by weight yttria.

The coating 38 may be applied via any one of several known technique including high velocity oxi-fuel, high velocity air-fuel, air plasma spray, vacuum or low pressure plasma spray, wire arc or flame spray. Of course, other non-spray techniques such as cladding or pre-sintered braze pre-forms could also be employed.

Figure 4:
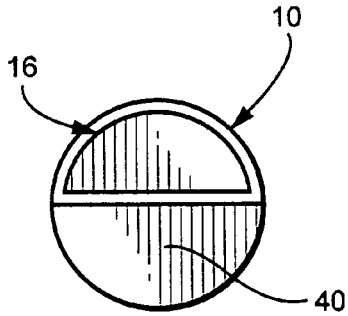
FIG. 4 is an end view of the damper pin prior to coating, showing the machined leading end of the pin.

One application technique also involves machining all of the surfaces of the semi-circular leading end to create a slightly reduced cross-section of the same semi-circular profile over substantially the entirety of the leading end in FIG. 4, to within about 80 mils of the shoulder 40, as indicated by the phantom line 42 in FIG. 1. The coating 38 is applied over this reduced profile region, and in the event the coating exceeds the original profile in any area, the excess may be machined away so that the coated region of the pin has substantially the exact dimensional shape as the original semi-circular end region (see FIG. 1). It should be understood, however, that the invention is not limited to any particular cross-sectional shape in the end region(s) of the damper pin.

After final machining, the residual coating 38 will have a thickness in the range of from about 4 to about 16 mils, and preferably about 8 mils.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of reducing corrosion and oxidation at a leading end of a damper pin located between adjacent buckets on a steam turbine rotor wheel comprising:

(a) machining said leading end to reduce a cross-sectional area of said leading end; and (b) applying a corrosion and oxidation-resistant coating to only said one end to a thickness such that said one end has a cross-sectional shape and area substantially equal to said leading end prior to step (a).

2. The method of claim 1 wherein said damper pin is composed of a cobalt alloy.

3. The method of claim 2 wherein said coating is an MCrAlY composition where M is iron, cobalt and/or nickel.

4. The method of claim 2 wherein said damper pin has a substantially uniform circular cross-sectional shape over an elongated main body portion between two ends, said two ends having a different cross-sectional shape.

5. The method of claim 1 wherein said different cross-sectional shape is semi-circular.

* * * * *